US006155108A

United States Patent [19]

Lunn

[11] Patent Number: 6,155,108

[45] Date of Patent: Dec. 5, 2000

[54] VALVE SEAT INSERT GAGING SYSTEM

[75] Inventor: Garfield R. Lunn, Amherstburg, Canada

[73] Assignee: Cobra Machine Tool Co., Inc., Tecumseh, Canada

[21] Appl. No.: 09/269,661

[22] PCT Filed: Jul. 29, 1998

[86] PCT No.: PCT/IB98/01163

§ 371 Date: Jun. 21, 1999

§ 102(e) Date: Jun. 21, 1999

[87] PCT Pub. No.: WO99/06676

PCT Pub. Date: Feb. 11, 1999

Related U.S. Application Data

[60] Provisional application No. 60/054,220, Jul. 30, 1997.

[51] Int. Cl.[7] ..... G01M 15/00

[52] U.S. Cl. ..... 73/119 R

[58] Field of Search ..... 73/865.8, 119 R; 348/86, 92, 94, 95, 82; 33/611, 654; 356/381, 383

[56] References Cited

FOREIGN PATENT DOCUMENTS 7286818 10/1995 European Pat. Off. .
7286824 10/1995 European Pat. Off. .

*Primary Examiner*—Robert Raevis
*Attorney, Agent, or Firm*—Carlson, Gaskey & Olds

[57] ABSTRACT

A valve seat insert inspection system generally comprises a camera which inspects the inner periphery of the valve seat insert adjacent the cylinder head. The camera detects the difference reflectivity of any gap between the valve seat insert and cylinder head. The image from the camera is analyzed in software to determine the size of the gap. A warning is indicated if the gap exceeds a predetermined threshold.

7 Claims, 1 Drawing Sheet

VALVE SEAT INSERT GAGING SYSTEM

This appln is a 371 of PCT/IB98/01163 filed Jul. 29, 1998 and also claims the benefit of U.S. Provisional No. 60/054,220 filed Jul. 30, 1997.

BACKGROUND OF THE INVENTION

Aluminum cylinder heads generally include sintered powder metal valve seat inserts in order to provide sufficient durability. Occasionally, the valve seat inserts must be properly installed into the cylinder head. An improperly installed valve seat insert will leave a gap between the aluminum cylinder head and the sintered powder metal valve seat insert. If the gap exceeds a threshold value, the valve seat insert will insufficiently line the aluminum cylinder head. Eventually, the cylinder head around the gap near the valve seat insert will fail, requiring expensive repair. Currently, there is no way of quickly measuring the size of the gap between the valve insert and the aluminum cylinder head.

SUMMARY OF THE INVENTION

The present invention provides an inspection system for inspecting installation of the valve seat inserts into bores in an aluminum cylinder head. Generally a camera takes an image of the valve seat insert and a portion of the cylinder head adjacent the valve seat insert. The image is analyzed to determine the size of any gap between the valve seat insert and the cylinder head. When the gap exceeds a predetermined value, the installation of the valve seat insert is determined to be defective.

In one embodiment, a CCD camera is used to take images of the valve seat insert. A mirror assembly mounted at an outer end of a lens of the CCD camera directs the image of the gap area into the CCD camera. By rotating the mirror, the CCD camera can obtain images from around the inner periphery of the gap area.

Generally, the valve seat insert and the aluminum cylinder head will be more reflective of light than the gap. The reduced reflectivity of the gap is measured by the CCD camera and detected by software. The size of the gap is automatically determined by the CPU and compared to a predetermined threshold. If the predetermined threshold is exceeded, the CPU indicates that the valve seat insert has been installed incorrectly, such as by a visual or audible warning.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
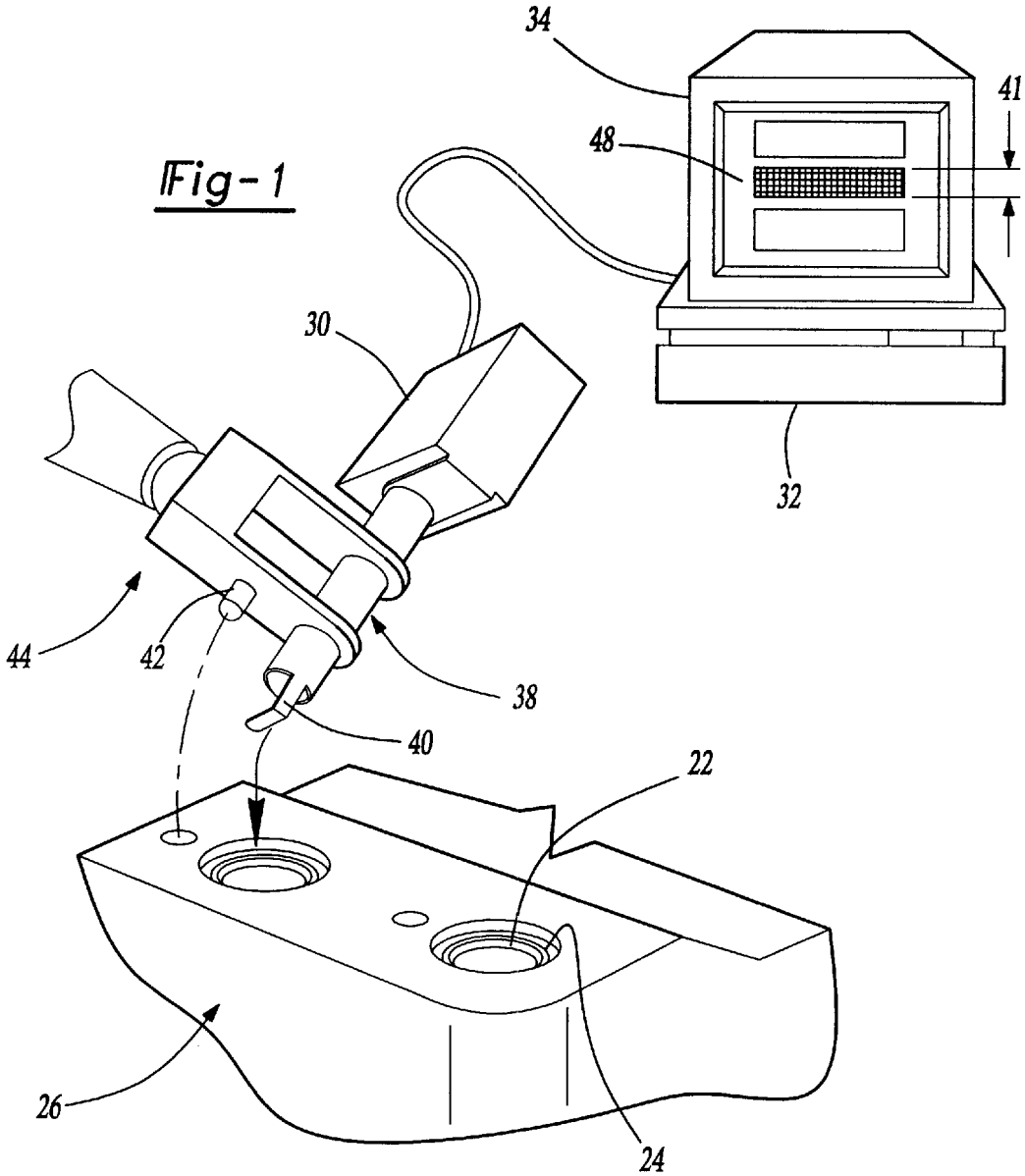
FIG. 1 illustrates a valve seat insert inspection system of the present invention.
Figure 2:
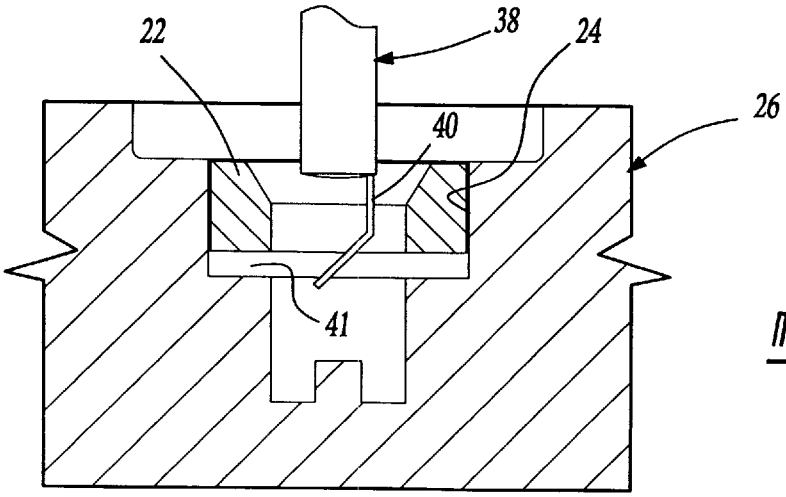
FIG. 2 is a sectional view of the CCD camera of the inspection system of FIG. 1 being inserted into a valve seat insert.

Referring to FIGS. 1 and 2, the present invention provides an inspection system 20 for inspecting the installation of valve seat inserts 22 into bores 24 in an aluminum cylinder head 26. The inspection system 20 generally comprises a camera 30 such as a CCD camera, providing an image to a CPU 32 having a monitor 34. The camera 30 is provided with a lens 38. A mirror assembly 40 is mounted at an outer end of the lens 38. The mirror 40 provides the necessary visualization of the gap 41 between the valve seat insert 22 and the cylinder head 26. The mirror 40 may be convex in order to provide a wider view around the periphery of the bore 24. Alternatively, the mirror 40 could provide reflective surfaces at several angles to provide images from sample areas the periphery of the bore. Alternatively, the mirror 40 could be mechanically moved to take sample images around the inner periphery of the bore 24. The lens 38 is selected to provide the necessary magnification and standoff distance to view and measure the gap 41. A light source 42 is provided to illuminate the aluminum cylinder head 26 and valve seat insert 22, such that the aluminum cylinder head 26 and valve seat insert 22 will reflect light, while the gap 41 between the two will be darker. The light source 42 may be mounted adjacent the lens 38. The camera 30, lens 38, mirror 40 and light source 42 are preferably mounted on the end of a movable robot arm 44 which can move the camera 30, lens 38, mirror 40 and light source 42 into place precisely to view each valve seat insert 22 and each of the bores 24 of the cylinder head 26. The robot arm 44 provides for the differences in orientation and position of the various bores 24 and the cylinder head 26. By mounting the camera 30, lens 38, mirror 40 and light source 42 on a compliant head, the surface of the valve seat itself can be used to ensure properly alignment of the optics in the bore 24. The intensity and orientation of the light source 42 are selected to accentuate the reflective differences between the aluminum cylinder head 26, valve seat insert 22 and gap 41.

As dirt may interfere with operation of the inspection system 20, the inspection system 20 preferably views the valve seat inserts 22 soon after the inserts 22 are installed into the cylinder head 26. Alternatively, a blast of air can be used to clean any debris from the gap 41 before inspection.

The image from the camera 30 is sent to a vision card in the CPU 32. The CPU 32 stores the image 48 from each valve seat insert 22 and bore 24. Preferably, various edge detection and area rendering routines measure the gap 41 size from the image 48. The CPU 32 then compares the gap 41 size to a predetermined threshold value. If the gap 41 size exceeds the predetermined threshold value, a warning system indicates to an operator that the valve seat insert 22 is improperly installed. Further, a full history of the manufacturing process can be saved on the CPU 32, allowing for statistical quality control and control of the process over time.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A system for inspecting the installation of a valve seat insert into a bore of a cylinder head comprising:

a camera for taking an image of the valve seat insert and a portion of the cylinder head adjacent the valve seat insert;

a computer analyzing the image to determine the size of a gap between the valve seat insert and cylinder head; and a rotatable mirror mounted in front of the camera, said mirror directing an image of the valve seat insert to said camera.

2. The system for inspecting the installation of a valve seat insert of claim 1 wherein said camera is a CCD camera.

3. The system for inspecting the installation of a valve seat insert of claim 1 further including a light source for projecting light into the bore.

4. The system for inspecting the installation of a valve seat insert of claim 1 wherein said computer indicates when said size of said gap exceeds a predetermined threshold.

5. The system for inspecting the installation of a valve seat insert of claim 1.

6. A method for inspecting the installation of a valve seat insert in a bore including the steps of:

inserting a mirror into the valve seat insert:

taking an image of a valve seat insert and a portion of the cylinder head adjacent the valve seat insert;

directing the image of the valve seat insert and gap into a camera with the mirror;

rotating the mirror in the valve seat insert;

analyze the image to determine a size of a gap between the valve seat insert and cylinder head;

7. The method of claim 6 further including the step of comparing reflectivity of areas in said image to determine the size of the gap.

* * * * *